US006290368B1

(12) United States Patent
Lehrer

(10) Patent No.: US 6,290,368 B1
(45) **Date of Patent: *Sep. 18, 2001**

(54) PORTABLE READING LIGHT DEVICE

(76) Inventor: Robert A. Lehrer, 3787 Winford Dr., Tarzana, CA (US) 91356-5808

( * ) Notice: Subject to any disclaimer, the term of this patent is extended or adjusted under 35 U.S.C. 154(b) by 0 days.

This patent is subject to a terminal disclaimer.

(21) Appl. No.: 09/316,715

(22) Filed: May 21, 1999

(51) Int. Cl.[7] ..... F21L 4/00

(52) U.S. Cl. ..... 362/187; 362/98; 362/103; 362/105; 362/184

(58) Field of Search ..... 362/184, 187, 362/800, 103, 105, 188, 190, 191, 804, 268, 277, 331, 98, 99

(56) References Cited

U.S. PATENT DOCUMENTS

| | | | | |
|---|---|---|---|---|
| D. 362,080 | | 9/1995 | Lehrer et al. | D26/39 |
| 1,187,672 | | 6/1916 | Stiefvater | 363/105 |
| 1,294,752 | | 2/1919 | Ballard . | |
| 1,392,165 | | 9/1921 | Hunter . | |
| 1,621,955 | * | 3/1927 | Schiffner | 362/187 |
| 2,117,967 | | 5/1938 | Leipold et al. | 240/59 |
| 2,725,462 | | 11/1955 | Vorgang | 240/2 |
| 3,008,040 | | 11/1961 | Moore | 240/41.15 |
| 3,250,909 | | 5/1966 | Oldenburger | 240/10.6 |
| 3,284,244 | | 11/1966 | Wallace | 128/23 |
| 3,624,384 | | 11/1971 | Ledingham | 240/6.42 |
| 3,634,676 | | 1/1972 | Castellano | 240/6.42 |
| 3,731,084 | | 5/1973 | Trevorrow | 240/6.4 W |
| 3,814,926 | | 6/1974 | Frasca | 240/6.4 W |
| 3,947,676 | | 3/1976 | Battilana et al. | 240/6.4 W |
| 4,234,910 | | 11/1980 | Price | 362/105 |
| 4,298,913 | | 11/1981 | Lozar | 362/103 |
| 4,462,064 | | 7/1984 | Schweitzer | 362/105 |
| 4,530,039 | | 7/1985 | Shin-Shi | 362/158 |
| 4,616,297 | | 10/1986 | Liu | 362/105 |
| 4,631,644 | | 12/1986 | Dannhauer | 362/105 |
| 4,718,126 | | 1/1988 | Slay | 2/175 |
| 4,734,834 | | 3/1988 | Petzl et al. | 362/187 |
| 4,759,615 | | 7/1988 | Bainbridge et al. | 350/399 |
| 4,794,496 | | 12/1988 | Lanes et al. | 362/105 |
| 4,797,793 | | 1/1989 | Fields | 362/105 |
| 4,916,579 | * | 4/1990 | Simms | 362/187 |
| 4,916,596 | | 4/1990 | Sharrah et al. | 362/190 |
| 4,947,291 | | 8/1990 | McDermott | 362/19 |
| 4,959,760 | | 9/1990 | Wu | 362/105 |
| 4,969,069 | | 11/1990 | Eichost | 362/105 |
| 4,970,631 | | 11/1990 | Marshall | 362/105 |
| 5,034,862 | | 7/1991 | Liston | 362/105 |
| 5,053,932 | | 10/1991 | Case | 362/105 |
| 5,068,768 | * | 11/1991 | Kobayashi | 362/277 |
| 5,086,378 | * | 2/1992 | Prince | 362/103 |
| 5,115,382 | | 5/1992 | Smith | 362/105 |
| 5,117,510 | | 6/1992 | Broussard et al. | 2/209.2 |
| 5,136,477 | | 8/1992 | Lemmey | 362/198 |
| 5,143,442 | * | 9/1992 | Ishikawa et al. | 362/184 |
| 5,230,558 | | 7/1993 | Jong | 362/105 |
| 5,325,275 | | 6/1994 | Liu | 362/80 |
| 5,353,205 | | 10/1994 | Hudak | 362/105 |
| 5,430,620 | | 7/1995 | Li et al. | 362/32 |
| 5,465,197 | | 11/1995 | Chien | 362/203 |
| 5,558,428 | * | 9/1996 | Lehrer et al. | 362/105 |
| 5,630,661 | * | 5/1997 | Fox | 362/187 |
| 5,660,460 | | 8/1997 | McLeod, Jr. | 362/103 |
| 5,676,449 | | 10/1997 | Newsome | 362/106 |
| 5,697,699 | | 12/1997 | Seo et al. | 362/252 |
| 5,722,762 | * | 3/1998 | Soll | 362/105 |
| 5,754,719 | | 5/1998 | Chen et al. | 385/34 |
| 5,797,672 | * | 8/1998 | Dobert | 362/800 |
| 5,800,042 | | 9/1998 | Blank | 362/105 |
| 5,842,779 | | 12/1998 | Siebert | 362/309 |

* cited by examiner

*Primary Examiner*—Sandra O'Shea
*Assistant Examiner*—John Anthony Ward
(74) *Attorney, Agent, or Firm*—Oppenheimer, Wolff & Donnelly, LLP

(57) ABSTRACT

A portable reading light device utilizing an LED as the source of light mounted in a housing having a plurality of focusing mirrors mounted therein.

18 Claims, 7 Drawing Sheets

FIG. 3
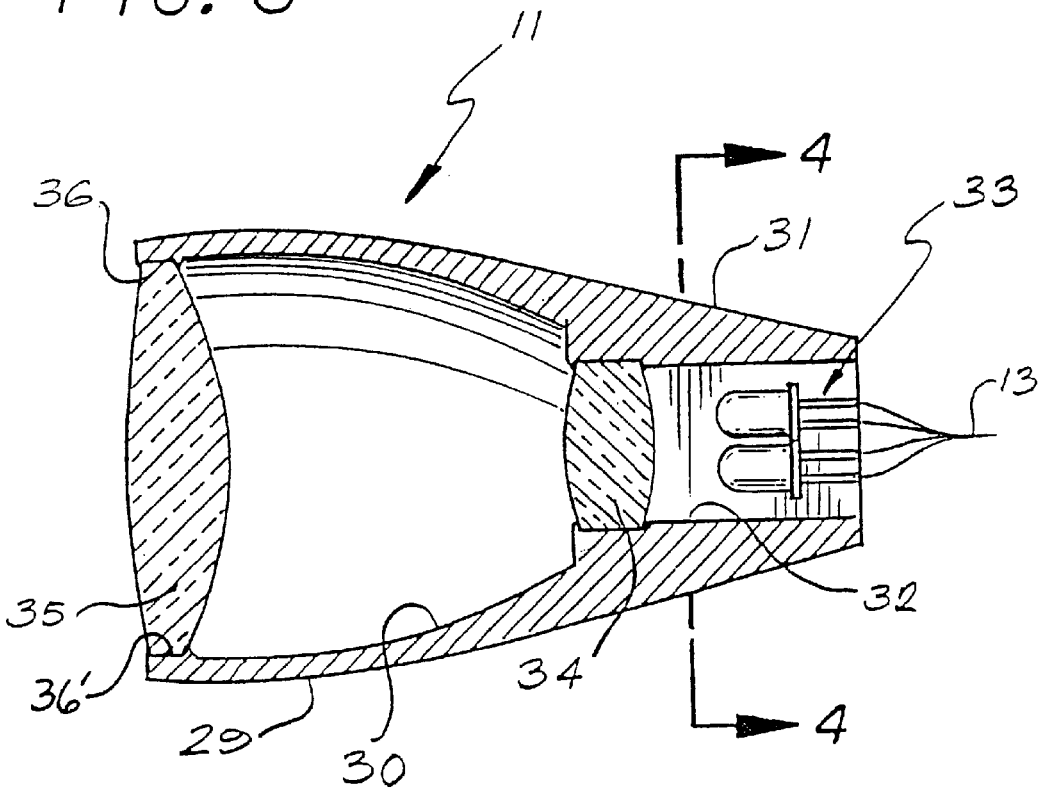
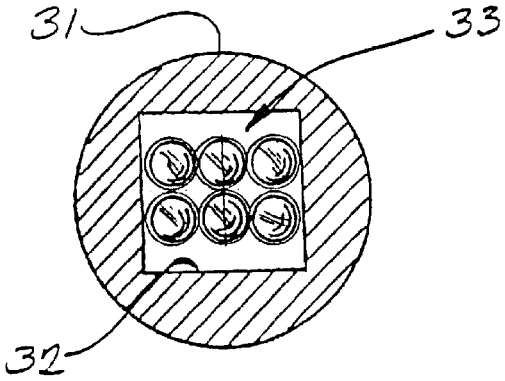
FIG. 4

FIG. 13
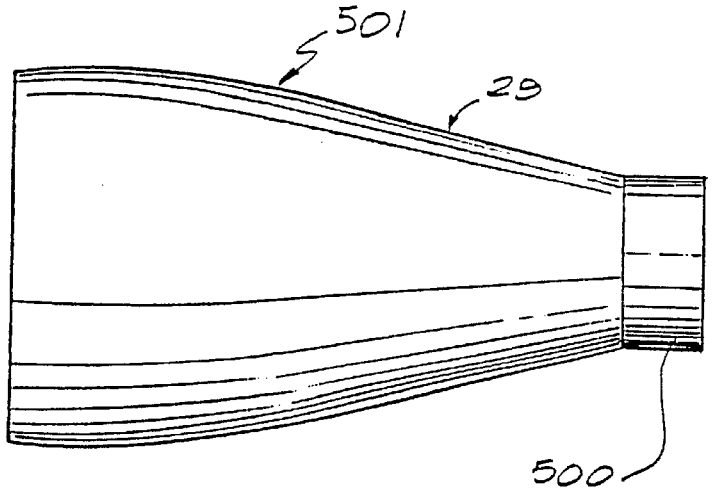
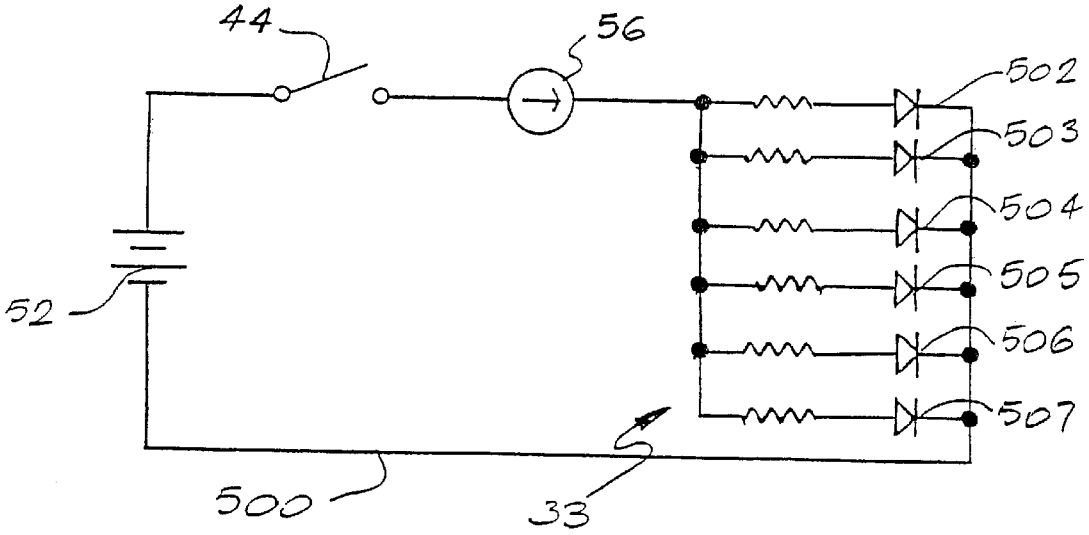
FIG. 14

PORTABLE READING LIGHT DEVICE

BACKGROUND OF THE INVENTION

1. Field of the Invention

The invention relates to portable reading lights; and, more particularly, to a light device adapted to be worn by a user or the like.

2. Related Art

Reading lights are well known in the art. In my U.S. Pat. No. 5,558,428, I disclose a portable reading light adapted to be worn about the head of a user. The light of the device projects a beam for reading a book or magazine or the like and is adjustable. The light of the device diffuses a beam substantially uniformly over a quadrilateral area so that the user can read a book or magazine with comfort.

Although this light device works quite well, the bulb used, disposed at the head of the user, generates quite a bit of heat. Increasing the intensity of the bulb to increase the amount of light generated would only add to the heat problem.

In my pending application Ser. No. 08/847,292, filed Apr. 24, 1997, I disclose another portable reading light device adapted to be worn about the head of a user or the like. This device utilizes a projection housing adapted to be used as the light source having the terminal end of a fiberoptic mounted therein, the other end extending to a remote lamp unit having a reflector and a light bulb mounted therein.

While this light device also works quite well, fiberoptics are quite expensive and the equipment used to generate the light output is cumbersome and expensive.

There is a need for a lightweight reading light that generates a bright, focused rectangular light using little power.

SUMMARY OF THE INVENTION

It is an object of this invention to provide a reading light using LEDs as the output of the light source.

It is still further an object of this invention to carry out the foregoing object directing the light source into a rectangular beam thereby making efficient use of light.

It is still further an object of this invention to carry out the foregoing objects spreading the light out more evenly than prior art devices.

These and other objects are preferably accomplished by providing a portable reading light device that utilizes LEDs as the light source focused through a series of lenses.

BRIEF DESCRIPTION OF THE DRAWING

FIG. 3 is a view taken along lines 3—3 of FIG. 2;

FIG. 4 is a view taken along lines 4—4 of FIG. 3;

FIG. 13 is a modified unit similar to the unit of FIGS. 1 to 3 having a circuit board and battery mounted thereon; and FIG. 14 is a diagram of a circuit which may be used for the circuit board of FIG. 7.

DESCRIPTION OF THE PREFERRED EMBODIMENT

Figure 1:
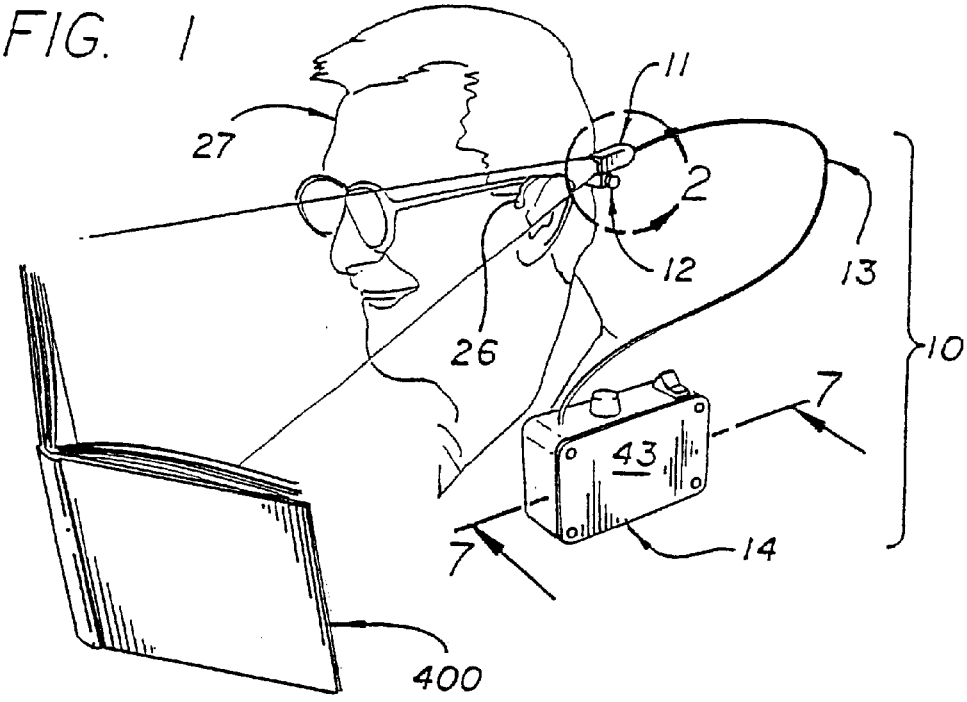
FIG. 1 is a perspective view of a light device worn by a user in accordance with the teaching of the invention.

Referring now to FIG. 1 of the drawing, device 10 is shown comprising a light projection unit 11, an integral clamping unit 12 (see also FIG. 2), a wire conduit 13 and a power unit 14 remote from projection unit 11.

Figure 2:
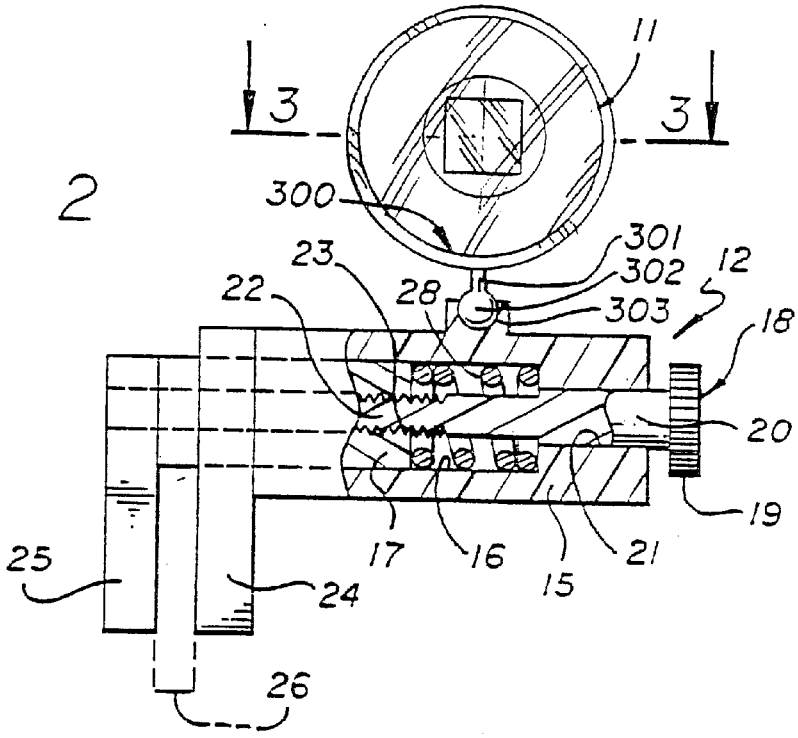
FIG. 2 is a view, partly in section, taken at line 2 of FIG. 1.

As seen in FIG. 2, light projection unit 11 is mounted on top of clamping unit 12 in any suitable manner. Preferably, a simple ball swivel arrangement 300 may be used to attach unit 11 to clamping unit 12. Thus, swivel arrangement 300 may have a shaft 301 secured to unit 11 terminating in a ball 302 rotatably mounted in a socket 303 fixed to clamping unit 12. The ball 302 may be rotatable in socket 303 yet retain a fixed position therein until moved due to its frictional relationship therein. The unit 11 thus can be adjusted to project light into book 400 as seen in FIG. 1. Clamping unit 12 comprises a main housing 15 having an inner chamber 16 with a square shaped slide 17 slidably mounted therein. A thumb screw 18 is provided having an enlarged head 19, which may be of nylon, disposed outside of housing 15, and an integral shaft 20 extending into a hole 21 in housing 15 aligned with chamber 16 terminating in a threaded portion 22 threadably receivable in a like threaded aperture 23 in slide 17 and fixed thereto. Housing 15 has an elongated flange portion 24 at the end opposite head 19, slide 17 extending therethrough. Slide 17 terminates in an elongated flange 25, fixed thereto, which is movable to and from flange 24 when head 19 is rotated thus moving flange 25 toward flange 24 clamping the earpiece 26 worn by user 27 in FIG. 1. If desired, a spring 28 (FIG. 2) may be provided within chamber 16 to resiliently bias flange 25 into clamping engagement with earpiece 26.

Projection unit 11 is shown in FIG. 3 having a main housing 29, which may be rounded at the rear for aesthetic purposes, and an inner light chamber 30.

Housing 29 may be a one-piece unit of any suitable material, as ABS plastic. Housing 29 has a restricted neck portion 31 at the rear having one or more light emitting diodes (LEDs) 33 mounted in the interior 32 of neck portion 31.

As seen in FIG. 4, although a single LED may be used, preferably a plurality, such as 6 disposed in 2 rows, each row having 3 LEDs therein, may be used. These LEDs are in abutting relationship and, as seen in FIG. 3, the lenses have their light beams focused along generally the central axis of the interior 30 of housing 29.

An initial combiner lens 34, which may be a rectangular double convex lens, is mounted inside neck portion 31 where it meets with the light chamber 30 of housing 29. A final imaging lens 36 which may be a round or oval double convex lens, is mounted at the opening out of chamber 30.

Figure 5:
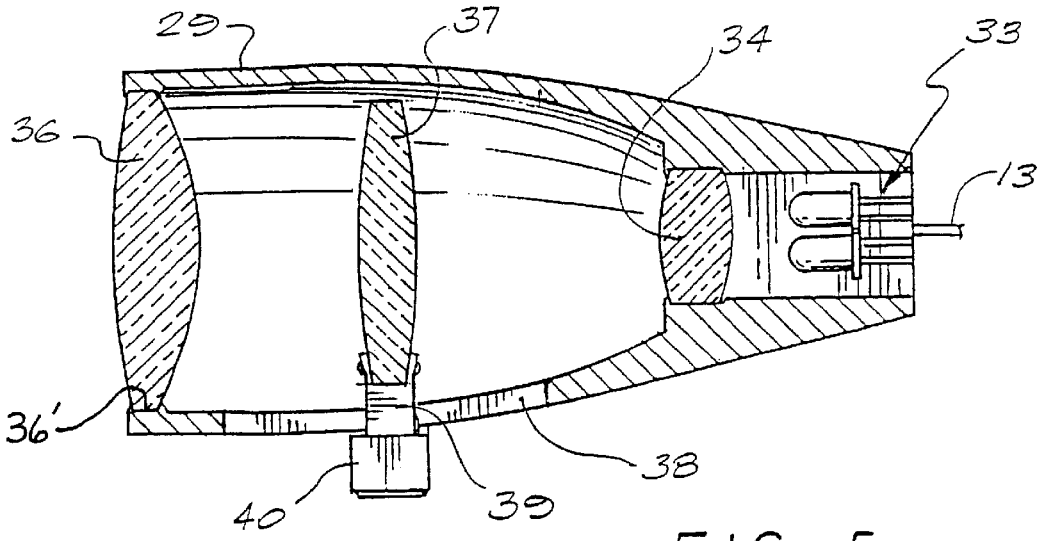
FIG. 5 is a view similar to FIG. 3 showing a modification thereof.
Figure 6:
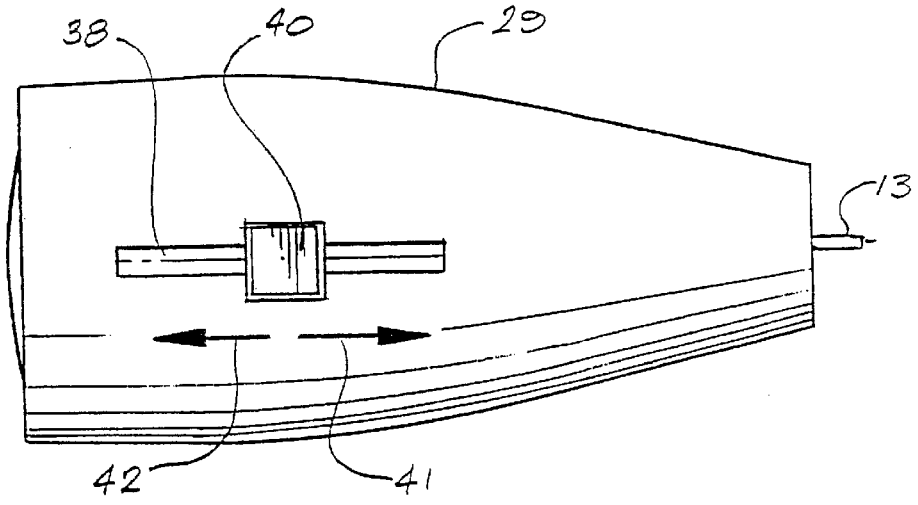
FIG. 6 is a perspective view of the housing alone of the modified unit of FIG. 5.

Although a fixed spot size image of light is provided using the unit of FIG. 3, as seen in FIG. 5, where like numerals refer to like parts of the unit of FIG. 3, the spot size image of light may be adjustable merely by mounting a third lens in the interior of chamber 30. Lens 37 may be movable between lens 34 and lens 36 to adjust the size of the image. This is accomplished by providing an elongated slot 38 in housing 29 (see also FIG. 6). Lens 37 is connected to slide 40 by a neck portion 39 (FIG. 5) extending out of slot 38 and connected to slide 40 which is greater in width than slot 38. Moving slide 40 along slot 38 in the direction of arrows 41, 42 (FIG. 6) varies the distance of lens 37 from lenses 34 and 36 and thus varies the size of the projected image of light.

Figure 7:
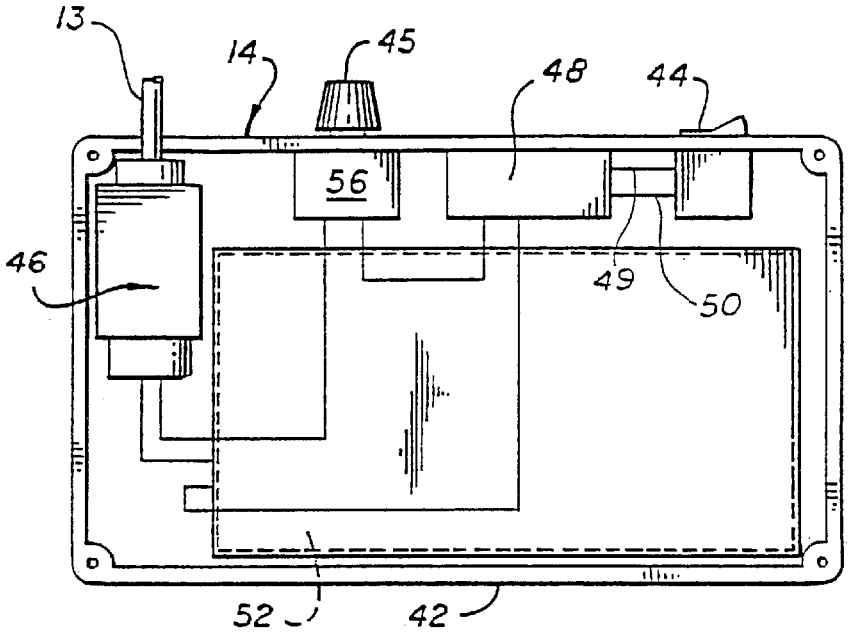
FIG. 7 is a view taken along lines 7—7 of FIG. 1.

Although the units of FIGS. 3 and 5 may be self-contained, as by having a suitable circuitry coupled to LEDs 33 and a source of electricity, it is preferable that the LEDs 33 be electronically coupled via conduit 13 to power unit 14 (FIG. 1). As seen in FIG. 7, power unit 14 has a main generally rectangular housing 42, normally closed off by a cover 43 (FIG. 1), having an on-off switch 44 accessible from the outside and a rheostat control knob 45, also accessible from the outside. Housing 29 also includes an LED circuit board 46 electronically coupled to the conduit 13 extending from housing 29.

Any suitable electronics may be used to power LEDs 33. For example, power switch 44 may be electronically coupled to a timing circuit 48 by leads 49, 50 (see also FIG. 8). Circuit 48 in turn receives power from battery 52 via lead 53. Lead 54 extends to circuit board 46. Lead 55 from circuit 48 extends to rheostat 56, controlled by knob 45 (FIG. 7). The lead 57 (FIG. 8) from circuit board 46 extends to rheostat 56. Rheostat 56, which could be a rheostat or resistor bank as is well known in the art, may be of any suitable type, such as 3 ohms, 7 watts.

Again, any suitable electronics, as will be discussed further, may be used. If desired, the timing circuit 48 and rheostat 36 may be eliminated. Circuit board 46 may be any suitable state of the art circuit board coupled to a battery that delivers an electronic current to LEDs 33 via conduit 13.

Figure 9:
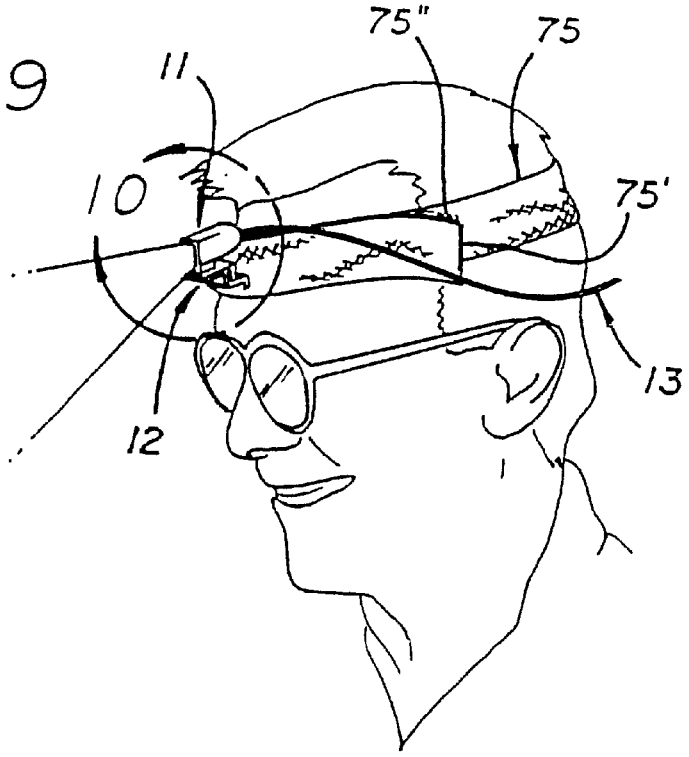
FIG. 9 is a perspective view of another embodiment of the manner in which the projection housing of the device of FIG. 1 may be mounted.
Figure 10:
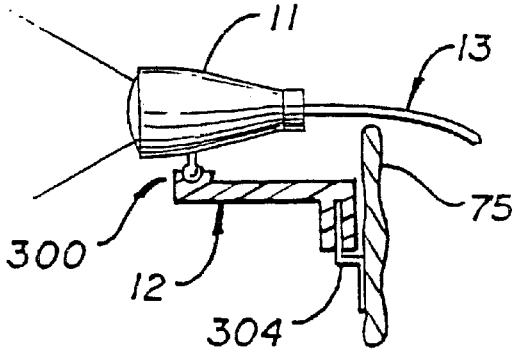
FIG. 10 is a view taken along line 10—10 of FIG. 9.

Although unit 11 is shown in FIG. 1 as mounted on the earpiece of a user, as seen in FIGS. 9 and 10, it may be mounted to the adjustable head band 75 of a user. This may be accomplished in any suitable manner, such as by having an L-shaped flange 304 (FIG. 10) fixed to headband 75 to which clamping unit 12 and unit 11 may be secured to. Thus, the position of unit 11 and clamp 12 may be adjustable to vary the direction of the light output. Headband 75 may be adjustable using mating pieces of Velcro® material 75', 75" in the manner discussed in my U.S. Pat. No. 5,558,428.

The manner of connecting unit 11 and clamp 12 to the earpiece 26 of FIG. 1 may be adjusted merely by moving the clamp 12.

Figure 11:
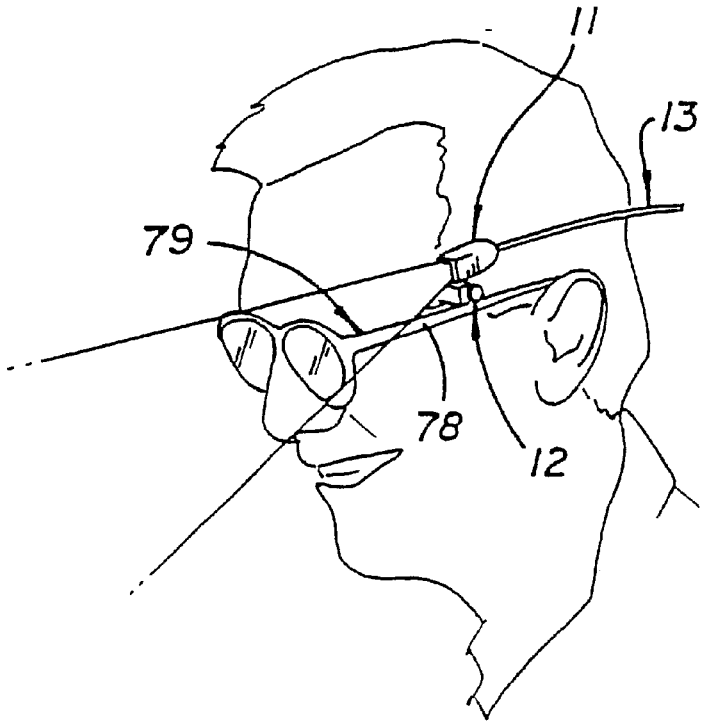
FIGS. 11 and 12 are perspective views of still further embodiments of the manner in which the projection housing of the device of FIG. 1 may be mounted.
Figure 12:
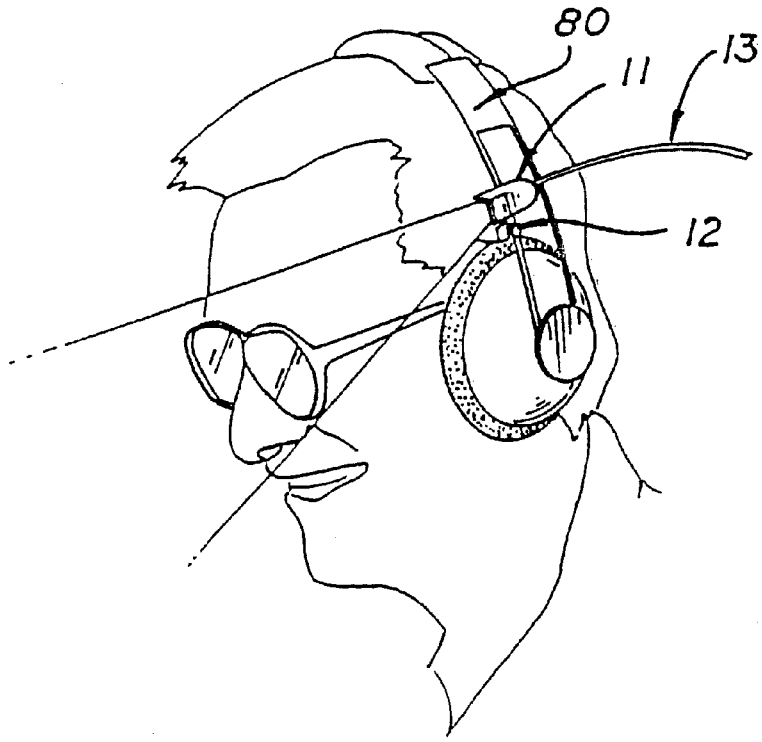

FIG. 11 shows still another variation wherein clamp 12 is clamped to the temple 78 of eyeglasses 79 by clamping the same therebetween in the manner of earpiece 26 in FIGS. 1 and 2. Finally, as seen in FIG. 12, clamp 12 may be clamped to earphones 80 worn by a user in the same manner.

Any suitable source of power may be used, such as alkaline or ni-cad batteries, AC current, etc. Preferably, a 5 volt rechargeable battery may be used to power LEDs 33 with a plug-in transformer to recharge the battery and provide power to LEDs 33 when plugged in as is well known in the bed lamp art. Control for the timing circuit may be provided by a 9 volt transistor-type battery. The same 9 volt battery may be used to provide current to circuit board 46 if the timer circuit and/or rheostat is eliminated.

It can be seen that the combination of LEDs 33 and a portable power source results in a high beam output with no humanly detectible heat at the output of the light housing.

Figure 8:
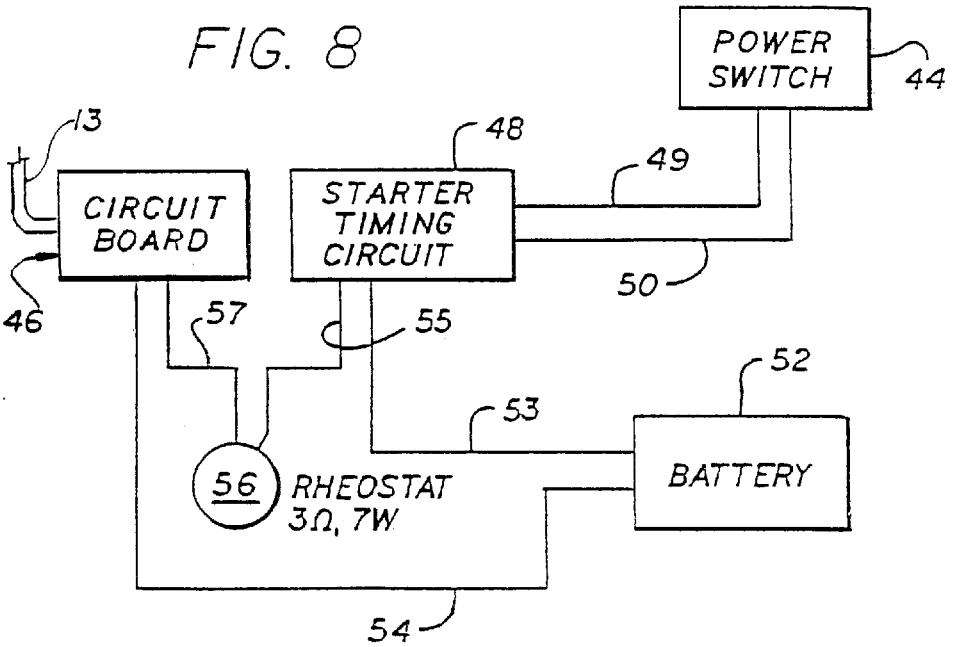
FIG. 8 is a schematic view of the circuitry of the device of FIG. 1.

As seen in FIG. 8, the control system may be comprised of a power switch 44, a rheostat 56, a starter, and a timing circuit 48. The power switch 44 is used to turn the timing portion on and off thus turning the lighting subsystem on and off. The rheostat 56 is used to control the light intensity.

Turning the rheostat knob in one direction makes the light brighter; turning in the opposite direction makes the light dimmer. The starter portion simply resets and initializes the timer portion in the starting and timing circuit. The starting and timing circuit is the heart of this subsystem. The timing circuit portion may use a simple linear integrated timer in a one shot configuration to control a switching relay. When power has been applied to the timing circuit portion, the starter portion can then be used to reset and initialize the timer portion. Upon initialization, the timer portion closes the switching relay which turns on the LEDs 33 and starts counting for its preset time period. When the preset time period has expired, the time portion opens the switching relay which turns off the LEDs 33 . The timing circuit will shut off the light after a predetermined period of time of use to save batteries or the like if the user fell asleep or otherwise did not turn it off.

Any suitable LEDs may be used. For example, white light emitting milky diffusion-type LEDs are preferred. A single LED having a typical luminosity of about 0.48 cd is preferred. An LED that emits light with 70° angle of directivity may be used. LEDs having a weight of less than about 0.5 grams may be used. Phosphorus coated LEDs may be used which emit a white light. Although one or more of such LEDs may be used, I prefer to use 6 mounted in 2 rows of 3 LEDs in each row. As used throughout "white," in reference to an LED does not refer to the actual color of the LED but the light emitted.

Any suitable dimensions may be used. For example, the housing 29 may be 46 mm. long and about 26 mm. in diameter. The tips of LEDs 33 may be about 10 mm. from lens 34. The LEDs are preferably 3 mm. round and frosted. Lens 34 may be approximately 12×17 mm. in configuration and lens 35 may be about 26 mm. in diameter. They may be about 23 mm. apart in FIG. 3. Lens 34 may be a rectangular double convex lens; lens 35 may be a round or oval double convex lens.

Although a single LED may be used, I prefer to use a plurality of LEDs, packed closely together as possible.

In order to minimize projected ghosts, e.g., stray light rays, the inside of the unit housing 29 may be flat black or made of a non-reflective material so that there are no internal reflections. However, if desired, the Housing 29 may be of a translucent material. In order to increase reliability, switching transistor may be used in place.

Although disclosed primarily as a reading light or lamp, my invention can be used by doctors, optometrists, dentists, etc. or anywhere a bright focused white light or any suitable colored light, such as red, is desired.

The brightest of the LEDs may be controlled by turning the, same on and off rapidly which lowers the flash rate and does not affect the steadiness of the light beam to the reader. This may be accomplished by pulse width modulation as is well known in the art. Modulation of the input current of a chip, such as a 555 timer chip, which turns the LEDs on and off at a high rate of speed may be used to control the brightness of the LEDs.

If desired, a simple circuit board device 500 may be mounted to the rear of housing 29 as seen in FIG. 13 wherein like numerals refer to like parts of the unit 11 of FIG. 3 and the circuit diagram of FIGS. 7 and 8. In FIG. 13, unit 501 is otherwise identical to unit 11 but a circuit board device 500, as shown in detail in FIG. 14, is electronically coupled to LEDs 33 as seen in FIG. 14 wherein like numerals refer to like parts of FIGS. 7 and 8. Here, for simplicity, timer 48 has been eliminated. Circuit board 500 thus includes 6 LEDs 502 through 507, connected in parallel so that, when switch 44 is turned on, LEDs 33 light. Thus, unit 501 may be totally self-contained using state-of-the art lightweight components and held in any suitable manner, even manually. Also, although 6 LEDs 502 through 507 are shown in FIG. 14, obviously any number may be provided.

It can be seen that there is disclosed an improved bed lamp having a high light projection, which can be adjustable, eliminating heat at the output. The light from the LEDs provides a clean bright white light easy on the eyes which may be in a rectangular pattern. The size of the image falling on the book or the like may be adjustable. Although a particular embodiment of the invention is disclosed, variations thereof may occur to an artisan and the scope of the invention should only be limited by the scope of the appended claims.

I claim:

1. A portable lightweight lamp for illuminating a subject comprising:

a light projection housing of a unitary structure having an opening at one end and terminating in a light output opening at the other end and having a longitudinal axis;

LED means mounted in said housing at one end thereof for emitting a source of light;

focusing lens means mounted in said housing remote from said LED means receiving therethrough the light emitted by said LED means and projecting a focused beam of light out of the housing; said means including a first lens mounted in said other end and a second lens mounted between said first lens and said LED means and being slidably mounted to said housing to linearly move along said longitudinal axis.

2. The lamp of claim 1 wherein said LED means includes 6 LEDs in 2 rows of 3 in each row disposed next to each other in abutting relationship.

3. The lamp of claim 2 wherein said LEDs are white frosted round LEDs.

4. The lamp of claim 1 wherein the size of the beam passing from said LED means through said first lens to said second lens is adjustable.

5. The lamp of claim 1 wherein said housing is about 46 mm. long and about 26 mm. in diameter at its open other end.

6. The lamp of claim 1 wherein said LED means is mounted in a neck in said housing, said neck communicating with an enlarged chamber in said housing, said lens means includes a first lens mounted in said neck and a second lens mounted in said other open end.

7. In the lamp of claim 1 including an adjustable clamp coupled to said projection housing for clamping the same to an adjustable headband of a user or a book.

8. In the lamp of claim 7 wherein an adjustable headband is provided having said clamp attached thereto.

9. In the lamp of claim 7 including an earpiece adapted to be worn by the user having said clamp attached thereto.

10. In the lamp of claim 1 wherein said housing is of plastic.

11. In the lamp of claim 1 wherein the interior of said projection housing is a non-reflective surface.

12. In the lamp of claim 1 wherein said projection housing is swivelly adjustable to a clamp thereby permitting said housing to be adjusted with respect to said clamp.

13. The lamp of claim 1 wherein said lens means includes a first rectangular double helix lens disposed in said housing spaced from said LED means and a second round double helix lens disposed in said other open end of said housing.

14. The lamp of claim 1 wherein said lens means includes a first rectangular double helix lens disposed in said housing spaced from said LED means and a second oval double helix lens disposed in said other open end of said housing.

15. The lamp of claim 1 including chip means associated with the LED means for controlling the brightness thereof.

16. The lamp of claim 1 wherein said LED means includes a plurality of LEDs, each being white light emitting milky diffusion type LEDs.

17. The lamp of claim 16 wherein each of said LEDs has a typical luminosity of about 0.48 cds and each emits light at about a 70° angle of directivity.

18. The lamp of claim 1 wherein the distance between said first lens and said LED means is fixed.

* * * * *